343-909 SR
11/17/81 XR 4,301,456

United States Patent [19]

Lovick, Jr.

[11] 4,301,456

[45] Nov. 17, 1981

[54] ELECTROMAGNETIC WAVE ATTENUATING SURFACE

[75] Inventor: Edward Lovick, Jr., Northridge, Calif.

[73] Assignee: Lockheed Corporation, Burbank, Calif.

[21] Appl. No.: 52,608

[22] Filed: Jun. 27, 1979

[51] Int. Cl.[3] ..... H01Q 1/52

[52] U.S. Cl. ..... 343/708; 343/786; 343/909

[58] Field of Search ..... 343/705, 708, 798, 544, 343/885, 778, 772, 786, 909

[56] References Cited

U.S. PATENT DOCUMENTS 3,541,559 11/1970 Evans ..... 343/798

3,618,106 11/1971 Bryant ..... 343/772

3,958,247 5/1976 Bogner et al. ..... 343/854

*Primary Examiner*—Eli Lieberman

*Attorney, Agent, or Firm*—Victor A. DiPalma

[57] ABSTRACT

Surface structures attached to a support member for reducing coupling between two antennas carried by the support member or for reducing the side lobes of a horn antenna, the structures consisting of thin metallic portions or strips partially covering dielectric material in layer form and the complete supporting structure being secured to the support member in order to present to an electromagnetic wave passing over the surface of the surface structure a surface impedance which is capacitive in nature in order to repel the electromagnetic wave away from the surface.

14 Claims, 14 Drawing Figures

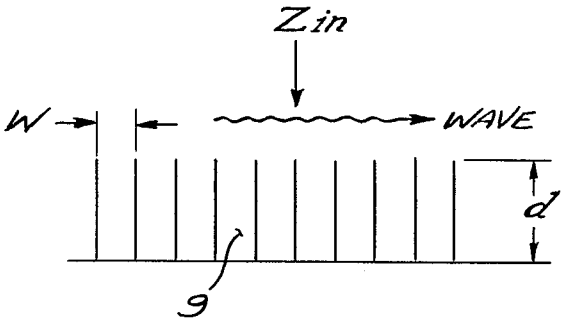
Fig. 1
PRIOR ART
Fig. 2
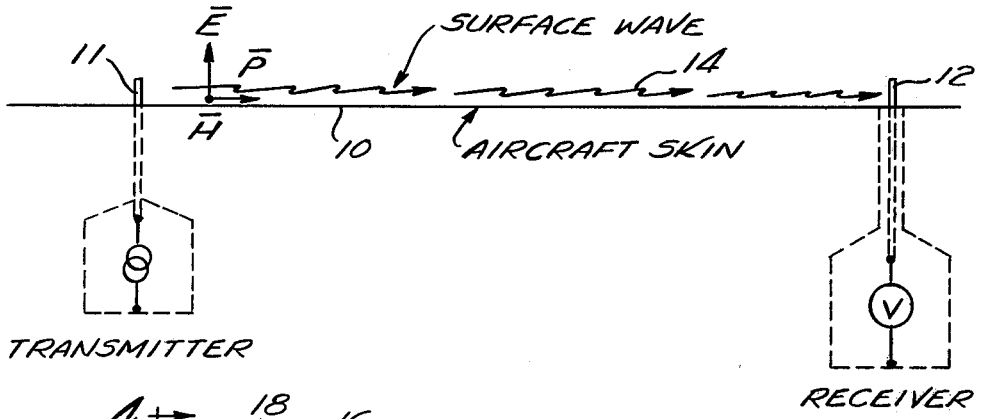
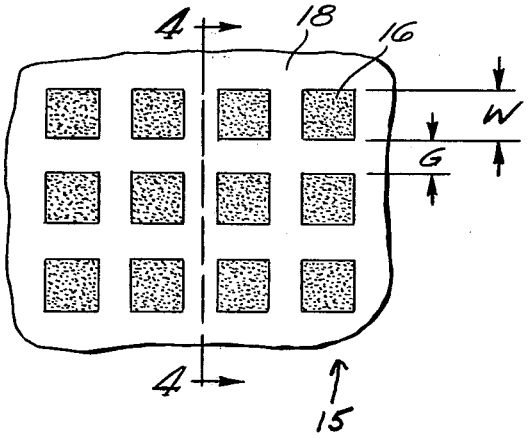
Fig. 3
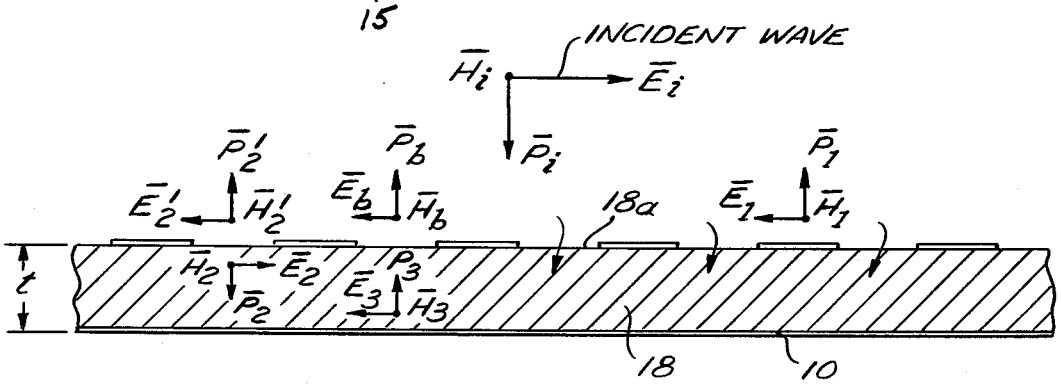
Fig. 4

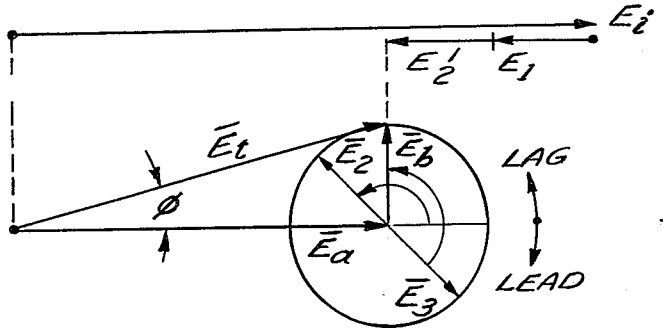
Fig. 5a
Fig. 5b
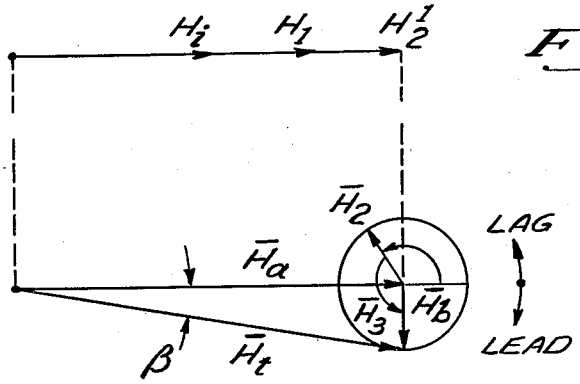
Fig. 5c
Fig. 5d
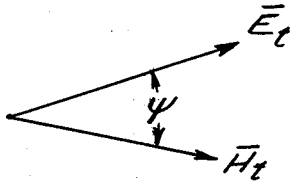
Fig. 5e
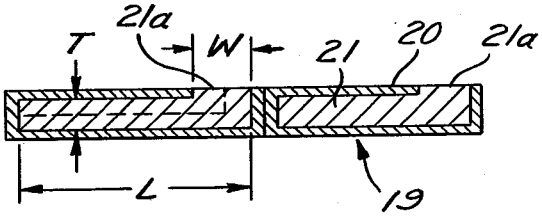
Fig. 6
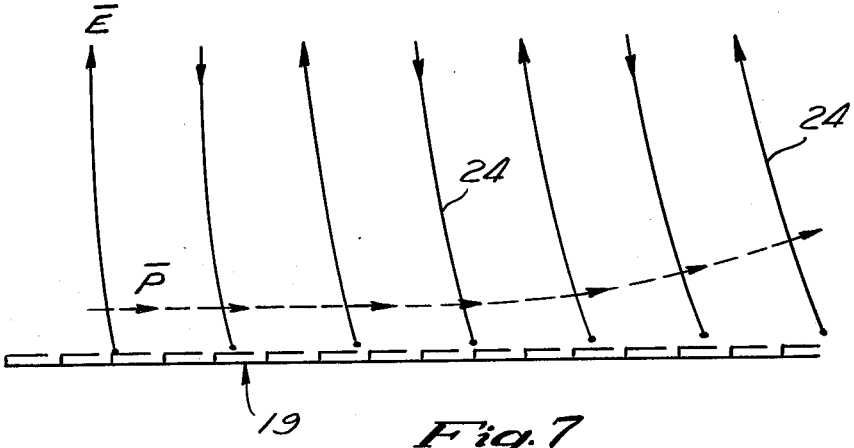
Fig. 7

Fig. 9
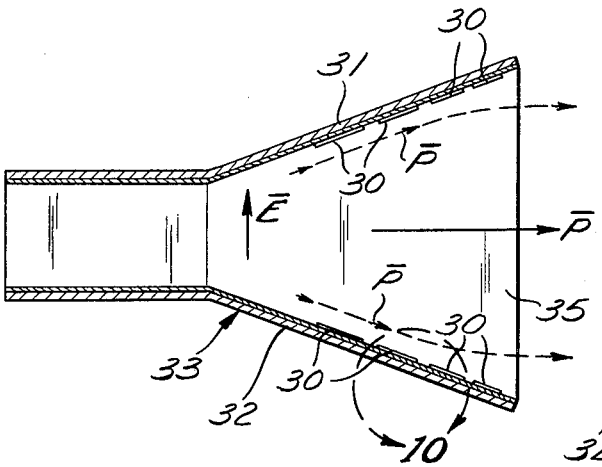
Fig. 8
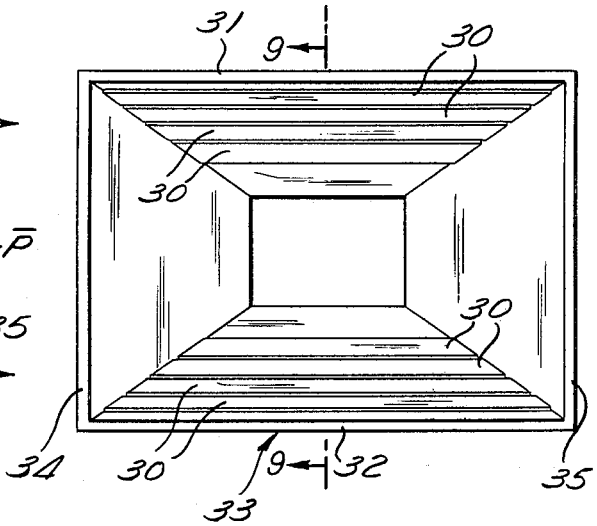
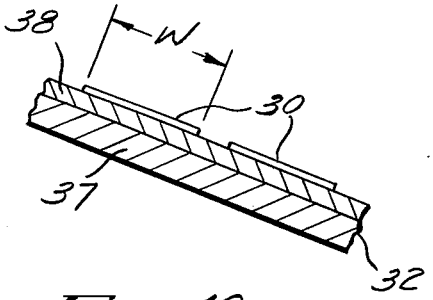
Fig. 10

ELECTROMAGNETIC WAVE ATTENUATING SURFACE

BACKGROUND OF INVENTION

It is desirable to obtain isolation between two antennas mounted on a metallic aircraft surface, such as when one antenna is transmitting and the other is a receiving antenna. It has been proposed to coat the surface of the aircraft with magnetically loaded elastomeric layers which, although they are thin for a given wave length, are quite heavy and therefore are not practical for long wave lengths in the order of a foot or more. The layer of material is expensive and difficult to fabricate and to install, and most importantly, it is very heavy and bulky if used for long wave lengths, thus adding materially to the weight of the aircraft. Basically, the layer of material consists of magnetic particles imbedded in the elastomer to act as magnetic absorbers to thereby reduce the coupling between the two adjacent antennas.

SUMMARY OF THE INVENTION

The present invention provides an attenuation means to reduce the coupling between one antenna and another, such as a transmitting antenna with a receiving antenna, by diverting the energy away from the surface of an aircraft before it reaches the receiving antenna. This is basically accomplished by causing the wave to be repelled from the surface by creating a surface whose impedance is described as being capacitive. The classical corrugated surface consists of an assembly of short-circuited wave guides of appropriate length whose open ends form the surface. Such a corrugated surface is discussed in the following text: "Field Theory of Guided Waves" by Robert E. Collin, McGraw-Hill Book Company, 1960, Pages 458 to 461 and 465 to 474. As stated therein, an electromagnetic wave whose electric field is perpendicular to a surface over which it is propagated, will be repelled from this surface if the wave impedance of the surface is capacitive in nature. It is further stated that the assembly of short circuited wave guides whose open ends form the surface can produce such a capacitive surface. See also: "Time-Harmonic Electromagnetic Fields" by Roger F. Harrington, McGraw-Hill Book Company, 1961, Pages 168 to 171. The present invention relates to producing such a capacitive surface which will repel the waves away from a surface, such as an aircraft surface, while still providing a compact structure which is light-weight and may be easily attached to an otherwise low-loss surface.

By the present invention, the repelling surface can be made of very thin conducting materials such as copper or aluminum foil, folded around an insulating material or dielectric. The thickness of the metal is only several skin depths thick which would amount to just a few thousandths of an inch so that typical foil available on the commercial market is perfectly adequate. Also, the dielectric material could be Teflon which is nearly an ideal dielectric in that it is extremely low in loss, has good physical properties, good compression strength and is bendable. The metallic foil can be wrapped around the dielectric slabs and then the required number of slabs can be cemented to the surface between the antennas to be isolated. Another form of structure adapted to produce a light-weight system which is capacitive in nature consists of placing patches of foil over a continuous layer of dielectric which is applied to the aircraft surface along which waves normally travel. The patches can be square, rectangular or other shapes and consist of a few thousandths of an inch of silver paint sprayed onto the dielectric surface through a mask or the patches can be printed by roller. These are examples of structures which produce the required capacitive surface in a compact form to provide a light-weight assembly which may be attached to an otherwise low-loss surface. When it is desired to reduce the side lobes of an antenna, strips of foil rather than patches can be applied to dielectric slabs on opposite sides of the interior of a rectangular horn to cause the $\overline{P}$ vector to move away from the horn surface at the end of the horn and thereby reduce the side lobes. In the case of a circular horn antenna, the dielectric material and conducting strips should cover the entire interior surface of the horn antenna.

BRIEF DESCRIPTION OF THE DRAWINGS

FIG. 1 is a schematic illustration of a prior art classical corrugated surface consisting of an assembly of short-circuited wave guides of appropriate length whose open ends form the surface;

FIG. 2 is a schematic illustration of a transmitting antenna and a receiving antenna located next to one another on the surface of the aircraft and illustrating the surface wave which would normally pass from the transmitter to the receiver;

FIG. 3 is a top plan view of one form of the invention in which highly conducting silver paint or metallic foil patches are secured to a dielectric which covers the surface of the aircraft;

FIG. 4 is a sectional view taken along line 4—4 of FIG. 3 illustrating the manner in which wave energy is reflected from the structure;

FIGS. 5*a*–5*e* are phasor diagrams illustrating the $\overline{E}_t$ vector lagging the $\overline{H}_t$ vector resulting in a surface impedence which is capacitive;

FIG. 6 is a side elevational section view of another form of the invention which consists of a conducting foil wrapped around successive slabs of dielectric material with a discontinuous space at the surface of the dielectric for admitting stray waves;

FIG. 7 is a schematic illustration illustrating the manner in which the P vector is forced away from the surface of the aircraft using the form of the invention of FIG. 6 or FIG. 3.

FIG. 8 is an end elevational view of still another modification consisting of a rectangular horn antenna having strips of foil on the interior of opposite sides;

FIG. 9 is a vertical section of the horn of FIG. 8 along line 9—9 illustrating the foil mounted on the dielectric material; and FIG. 10 is an enlarged section at location 10 of FIG. 9.

DESCRIPTION OF THE PREFERRED EMBODIMENTS

An electromagnetic wave whose electric field is perpendicular to a surface over which it is propagating, such as the surface of FIG. 1, will be repelled from that surface if the wave impedance of that surface is capacitive in nature (see "Field Theory of Guided Waves" by Robert Collin, supra, Pages 458 to 461). For such a surface, if $\lambda/4<d<\lambda/2$, the surface impedance, Z in is capacitive and a wave traveling along the surface will be forced away from the surface and rejected; "λ" being the wave length inside the wave guide sections 9 and "d" being the depth of the wave guide sections. There are several section openings per wave length, the width W of the openings should be small compared to the wave length, and the separation between sections should be small compared to W.

The present invention provides surface structures which perform to produce the same capacitive surface impedance as the short circuited wave guide sections of FIG. 1 and are more adaptable to being attached to an otherwise low-loss surface since they are in more compact form and provide a thin light-weight assembly. The surface structures, being capacitive in nature, divert the energy away from the surface of the aircraft so that most of it will not go from one antenna to the other. FIG. 2 illustrates a typical aircraft surface 10 between a transmitter antenna 11 and a receiver antenna 12 and the surface wave resulting in undesired coupling between the antennas is illustrated by lines 14. The $\overline{E}$, $\overline{H}$ and $\overline{P}$ vectors at the surface are also illustrated.

One form of the invention is illustrated in FIGS. 3 and 4 and consists of surface structure 15 having metallic patches 16 placed upon a layer 18 of dielectric which is applied directly to the surface of the aircraft. The patches can be fabricated of several layers of silver paint, metallic foil or the like, which is highly conductive. The patches may be square, rectangular, circular, hexagonal or any other suitable shape. Silver paint having a thickness of a few thousandths of an inch can be sprayed onto the surface of the dielectric through a mask or printed on by a roller. The dielectric 18 can be applied directly to the surface of the aircraft in any suitable manner, such as by cement and the surface of the aircraft serves as the support member for the surface structure.

Referring to FIG. 4, the components of the incident wave above the surface are indicated with the subscript "i"; the components of the portion of the incident wave reflected from the metallic patches 16 are indicated by the subscript "1"; and the components of the portion of the incident wave which penetrates the interface 18*a* and is delayed by the dielectric medium, is indicated by the subscript "2". This component reflected by the metal surface 10 is indicated by subscript "3" and after crossing the interface in the opposite direction is indicated by the subscript "b", and the component reflected from the interface is indicated by subscript "2" prime.

FIG. 5 shows an example of such an assembly in which the wave components propagating in the dielectric experience a delay equivalent to $\frac{3}{8}$ of a wave length ($\frac{3}{8}$ of the wave period) in each direction. In actuality, the amount of delay is determined by the type of material and its thickness, and this amount of delay is typical of that which is obtainable.

The total electric field at the plane of the upper interface at the instant of impingement is given by $$\overline{E}_a=\overline{E}_i+\overline{E}_1+\overline{E}_2$$

and is illustrated by FIG. 5*a*. In FIG. 5*b*, the wave component $\overline{E}_2$ is shown after a delay corresponding to $\frac{3}{8}$ of the wave period, just before it strikes the metallic surface 10.

Upon reflection from the metallic surface, the wave component $\overline{E}_2$ is reversed in sense and is designated by $\overline{E}_3$ in FIG. 5*b*. After further delay of $\frac{3}{8}$ of a period, component $\overline{E}_3$ emerges as $\overline{E}_b$ and combines with the field component $\overline{E}_a$ to yield the total electric field $\overline{E}_t$.

$$\overline{E}_t=\overline{E}_a+\overline{E}_b$$

Similar treatment of the phasors representing the magnetic field components using the relations $$\overline{H}_a=\overline{H}_i+\overline{H}_1+\overline{H}_{2'}$$

and $$\overline{H}_t=\overline{H}_a+\overline{H}_b$$

together with the phasor representations of FIGS. 5*c* and 5*d*, results in the total electric field, $\overline{E}_t$, lagging the total magnetic field $\overline{H}_t$ by the angle $\psi$ shown in FIG. 5*e*

$$\psi=\phi+B$$

Since the electric field lags (builds up, subsides and then repeats later in time than does the magnetic field) the total surface impedance is capacitive and the wave energy traveling along the surface is repelled.

In FIG. 3, "W" defines the width of a square patch and "G" defines the gap between the patches on all sides. It has been experimentally determined that the following relationship should exist between "W" and "G" to produce a capacitive surface: $1 \leqq W/G \leqq 2$. It is recommended that 10 to 20 metallic patches be utilized per wave length. If the wave length equals two inches, the patches could be 1/20th to 1/40th of a wave length if $W/G=1$ so that $0.025 \leqq W \leqq 0.05$ (approximately). If "T" equals the thickness of the dielectric; "K" equals the relative dielectric constant of the dielectric and $\sqrt{K}$ equals the index of refraction, then $\lambda/4 \leqq T\sqrt{K} \leqq \lambda/2$. The index of refraction of Teflon, methyl Methacrylate, fiber glass and a class of materials containing insulated metal particles ("artificial" dielectrics) make them suitable materials for the substrate, thereby providing thin, light weight dielectric layers.

Another form of surface structure 19 illustrated in FIG. 6 consists of a thin metallic foil 20 wrapped around dielectric slabs 21 and then the required number of slab units are cemented to the support member (aircraft surface) transverse to the line between antennas to be isolated. If "L" equals the inside dielectric length, "T" the inside dielectric thickness, "W" the width of the exposed dielectric surface 21*a*, "K" the relative dielectric constant of the dielectric 21, and $\lambda$ the wave length of the incident wave, then the phase lag $\psi$ associated with the wave traveling inside the dielectric is $$\psi = \frac{2\pi}{\lambda o}\sqrt{K}\left\{2\left[L-\frac{W}{2}+\frac{T}{2}\right]\right\}$$
$$= \frac{2\pi}{\lambda o}\sqrt{K}\,\{2L-W+T\}$$
$$= \frac{4\pi\sqrt{K}\,L}{\lambda o} \text{ if } W=T.$$

In order to operate over an octave band-width (maximum wave length equals twice minimum wave length), chose the wave length equal to the geometric mean of the wave lengths as the design basis; i.e., $$\lambda_o=\sqrt{2}\lambda\text{min.}$$

then, the inside length, L, can be found from $$L = \frac{\sqrt{2}\ \lambda min\psi}{4\pi\sqrt{K}}$$

$$= \frac{11.811\sqrt{2}}{4\pi}\left(\frac{\psi}{F\sqrt{K}}\right) \text{ inches}$$

For the minimum wave length (maximum frequency) the total phase lag should be less than $\pi$. That is, for a capacitive surface impedance, $$\frac{\pi}{2} \leqq \psi \leqq \pi.$$

Choosing the maximum phase shift, the length, L, is:

$$L = \frac{11.811\sqrt{2}}{4F\sqrt{K}} \text{ inches}$$

where frequency F is expressed in GHz. As an example:

Let F=3 GHz

K=4

$$L = \frac{11.811\sqrt{2}}{(4)\ (3)\ (2)} = 0.696'' \simeq 0.7''$$

Since W equals T for this example, W may be adjusted to regulate the coupling between the waves in the cavities and the waves in the space outside the repelling structure. The dielectric thickness then can be adjusted using W equal to T as a first approximation.

As illustrated in FIG. 7, the E plane energy (lines 24) is shown as being accelerated along the surface so that the E plane bends and leaves the surface after traveling over the surface. It is understood that the same effect is produced by the surface structure of FIG. 4. This results from the fact that the surface is adjusted with a path length so that the delay is such that the wave would get the effect of being speeded up near the surface. The mechanism for controlling the wave and forcing the wave from the surface is to delay the current sheet flowing on or near the surface sufficiently, and that means more than a half wave length, to cause the vector sum of the fields to appear to be going faster than the fields in space near the surface, but well away from it.

Of the two typical embodiments shown in FIGS. 3 and 6, the arrangement of FIG. 3 is more suited to ease of fabrication and installation, particularly on curved surfaces. Simpler fabrication and/or assembly techniques (for example, printing or spray painting) may be employed for FIG. 3.

The repelling surfaces, such as those described by FIGS. 3 and 6, should extend transversely to the line between the antennas sufficiently far so as to influence significantly substantially all the paths by way of which wave energy can couple from one antenna to the other. The extent of such transverse dimension is best determined experimentally by physical measurement.

The use of the patches in FIG. 3 allows the thickness of the dielectric to be reduced because of the reverberation resulting between the patch and the aircraft surface increases the travel time and distance the wave components penetrate the dielectric thereby increasing the phase lag. In the embodiment of FIG. 6, the increase of travel in the dielectric is provided by the length of the dielectric which must be traversed by the wave energy reflected by the side walls. Thus, both forms of the invention provide a capacitive surface with minimum increase of thickness at the aircraft surface.

The surface impedance at the interface between space and the structure of FIG. 3 is determined by the physical dimensions of its parts; i.e., patch width W, gap width G, substrate thickness T, and in the case of the embodiment of FIG. 6, the length L, gap width W, and dielectric thickness T, the dielectric constant of the insulating material and the wave length (or frequency) of the waves. The various combinations of parameters can be adjusted to yield either inductive (attracting) surface impedance or capacitive (repelling) surface impedance for a given wave length.

For a given set of dimensions and insulating materials these structures perform according to Flouquet's Theorem which states that periodic structures will alternately change character (inductive to capacitive and back) as the exciting wave length changes if it varies over a sufficient range. Therefore, a given structure will behave in opposite fashion if the exciting wave length is changed sufficiently. In order to assure that the surface impedance for the surface structures of FIGS. 3 and 6 are capacitive, they must provide a wave lag $\psi$ within the following:

$$\frac{\pi}{2} \leqq \psi \leqq \pi \text{ and}$$

$$3/2\pi \leqq \psi \leqq 2\pi$$

This assures that the electric component lags the magnetic component.

It is understood that various other surface constructions can be utilized which cause the surface impedance to be capacitive in nature so that the surface will repel electromagnetic waves whose electric field is perpendicular to the surface along which it is propagating. For example, in a situation in which there is a preferred direction of propagation, excluding all others (except in the opposite direction), a simplified construction utilizing strips of width W (corresponding to W of FIG. 3) transverse to the preferred direction of propagation may be employed. Such a modification utilizing strips 30 is illustrated in FIGS. 8 through 10 and the strips 30 are spaced along the top surface 31 and bottom surface 32 of the rectangular horn 33 but not on side surfaces 34 and 35. The wall of horn 33 is fabricated from a conducting metal material 37 on which is placed a dielectric layer 38 of material similar to that of material 18 in FIG. 3. Since the direction of propagation in the horn 33 is axially along the horn, the strips 30 are located transversely to the direction of propagation. There is no need for strips along the sides of a rectangular horn structure, but in the case of a circular horn antenna, the dielectric material and conducting strips should cover the entire interior surface of the horn. In the modification of FIG. 3, substantially square patches were illustrated with equal spaces in both directions so that the surface impedance is substantially independent of the direction of propagation over the surface. However, in FIG. 9, since the propagation is unidirectional, always in one direction, it is not necessary to use separate patches along the opposite sides 31 and 32 and the easier mounted solid strips can be utilized on these sides to produce the capacitive system.

It is understood that the function of the dielectric layer in the modification of FIGS. 8 through 10 is the same as in that of FIG. 3 and its function is to control the surface impedance. Since the electric field lags the magnetic field, the side surfaces containing the conducting strips 30 are capacitive and thereby repel the wave energy as it passes along the axis of the horn, much in the same manner as illustrated by the wall 19 of FIG. 7. As illustrated in FIG. 9, the Poynting vector $\overline{P}$ leaves the surface containing the strips 30 and decreases the field intensity of the propagated wave at the front edge of the horn, and the result is the reduction of side lobes in the $\overline{E}$ plane radiation pattern. It is understood that the manner in which the surface of the third modification is made capacitive is based the same theory as explained in connection with the operation of the surface of FIG. 3 and the only difference between the surfaces of the first and third embodiments is that the conductor is made in strips in FIG. 9 whereas it is made in patches in FIG. 3 to obtain isotropy. It should be apparent that this invention is useful for those cases in which both the transmitter and the receiver to be isolated are tuned to approximately the same wave length (frequency) and for reduction of E plane radiation pattern side lobes of horn antennas.

What is claimed is:

1. A surface structure for reducing the coupling between a transmitting antenna and a receiving antenna located in the proximity of one another on a support member including:

means for attaching said surface structure to said support member;

said surface structure comprising thin metallic reflecting portions secured to a dielectric material in layer form and positioned between said support member and said metallic portions;

said transmitting antenna producing an electromagnetic wave traveling along the surface of said surface structure toward said receiving antenna;

said metallic portions being spaced apart on said dielectric material to provide said surface with both matellic and dielectric surface portions; and said metallic portions and said dielectric material being constructed to provide said surface with a wave impedance capacitive in nature to repel the wave energy from said surface and away from said receiving antenna.

2. A surface structure as defined in claim 1 wherein:

said metallic portions have a thickness of a few thousandths of an inch, said metallic portions causing the wave energy entering said dielectric material to reverberate in said dielectric material.

3. A surface structure as defined in claim 1 wherein the total electric field $\overline{E}_t$ lags the total magnetic field $\overline{H}_t$ at said surface causing the impedance of the surface structure to be capacitive.

4. A surface structure as defined in claim 1 wherein said layer of dielectric material is attached directly to said support member, said metallic portions comprising a plurality of metal foil patches spaced apart on said dielectric material to produce similar dielectric surface portions therebetween.

5. A surface structure as defined in claim 4 wherein said patches are square and are sized to be 1/20th to 1/40th of a wave length.

6. A surface structure as defined in claim 1 wherein said dielectric material comprises individual slabs extending transversely to the direction of the line between said two antennas, each of said metallic portions being wrapped partially around one of said slabs to provide said metallic and dielectric surface portions.

7. A surface structure as defined in claim 6 wherein said slabs are rectangular in shape, each of said metallic portions comprising a layer of foil wrapped around one of said slabs to cover the bottom, both ends and a portion of the top adjacent one end of said one slab, thereby leaving an uncovered surface portion of each slab adjacent one end thereof, said slabs being positioned in edge-abutting relationship with foil on the bottom being cemented to said support member.

8. A surface structure as defined in claim 7 wherein the length of each of said slabs in inches is $$L = \frac{11.811\sqrt{2}}{4F\sqrt{K}}$$

where F is in GHz and K is the dielectic constant.

9. An electromagnetic wave attenuating surface for reducing coupling between proximately located transmitting and a receiving antenna comprising a layer of dielectric material secured to a support member;

separate portions of thin metallic reflecting material secured to the surface of said dielectric material;

said portions being spaced apart in the direction of wave propagation from said transmitting antenna along said support member;

said electromagnetic wave attenuating surface structure consisting of said metallic portions and said dielectric material providing a surface with a wave impedance capacitive in nature to repel said propagated wave from said attenuating surface.

10. An attenuating surface as defined in claim 9:

said support member being an interior surface of an antenna horn, said metallic material being in the form of strips spaced apart along the direction of wave propagation in said horn, said attenuating surface repelling said wave energy at the front end of said horn to reduce the side lobes in the radiation pattern.

11. An attenuating surface as defined in claim 10; wherein said antenna is a rectangular horn antenna, said strips being located only on opposite sides of said horn.

12. An attenuating surface as defined in claim 10; said support member being the interior surface of a circular horn antenna, said metallic material being in the form of strips spaced apart along the direction of wave propagation and passing around said interior surface.

13. An attenuating surface as defined in claim 9:

said support member carrying a transmitting antenna and a receiving antenna in proximity to one another, said portions of metallic material being spaced apart along the direction between said two antennas.

14. An attenuating surface as defined in claim 13 wherin said metallic portions are in the form of patches spaced from one another in all directions.

* * * * *